United States Patent [19]

Jarnuszkiewicz et al.

[11] Patent Number: 4,546,751

[45] Date of Patent: Oct. 15, 1985

[54] METHOD OF PREPARING A COMBUSTIBLE MIXTURE IN AN INTERNAL COMBUSTION PISTON ENGINE

[75] Inventors: Stanislaw Jarnuszkiewicz; Marek Jarnuszkiewicz, both of Kraków, Poland

[73] Assignee: Politechnika Krakowska, Krakow, Poland

[21] Appl. No.: 646,481

[22] Filed: Aug. 31, 1984

Related U.S. Application Data

[63] Continuation of Ser. No. 365,677, Apr. 5, 1982, abandoned.

[30] Foreign Application Priority Data

Apr. 24, 1981 [PL] Poland ..... 230855

[51] Int. Cl.[4] ..... F02M 33/00

[52] U.S. Cl. ..... 123/568; 123/73 BA

[58] Field of Search ..... 123/73 B, 73 BA, 288, 123/289, 291, 568, 569, 661, 65 R

[56] References Cited

U.S. PATENT DOCUMENTS

| | | | |
|---|---|---|---|
| 1,530,864 | 3/1925 | Vaughan | 123/568 |
| 2,087,116 | 7/1937 | Prentiss | 123/568 |
| 2,239,239 | 4/1941 | Lundell | 123/73 B |
| 2,643,647 | 6/1953 | Meyer et al. | 123/568 |
| 2,757,654 | 8/1956 | White | 123/568 |
| 3,068,845 | 12/1962 | Leunig | 123/532 |
| 3,127,878 | 4/1964 | Leunig et al. | 123/532 |
| 3,205,876 | 9/1965 | Stuhr | 123/532 |
| 3,229,676 | 1/1966 | Ulbing | 123/661 |
| 3,270,721 | 9/1966 | Hideg et al. | 123/291 |
| 3,799,130 | 3/1974 | Dahlstrom | 123/568 |
| 3,881,454 | 5/1975 | Jaulmes | 123/73 B |
| 4,119,071 | 10/1978 | Hattori | 123/568 |
| 4,271,810 | 6/1981 | Lancaster | 123/568 |

FOREIGN PATENT DOCUMENTS

| | | | |
|---|---|---|---|
| 0113721 | 9/1979 | Japan | 123/568 |

*Primary Examiner*—Ira S. Lazarus
*Assistant Examiner*—R. S. Barley
*Attorney, Agent, or Firm*—Ladas & Parry

[57] ABSTRACT

A method of preparing a mixture consists in successive performing of: atomization of fuel in a stream of exhaust gases, introduction during suction or an exchange of the load an incombustible fuel-combustion mixture to a separate storage space, compression—in a positive-displacement manner without mixing—of the mixture with the air inflowing to the storage space from the working space of the engine, forcing through of the compressed mixture into the combustion chamber before the top dead center of the piston completing the compression stroke, and in production of a combustible mixture by mixing with air compressed in the combustion chamber.

1 Claim, 5 Drawing Figures

METHOD OF PREPARING A COMBUSTIBLE MIXTURE IN AN INTERNAL COMBUSTION PISTON ENGINE

This application is a continuation of application Ser. No. 365,677, filed Apr. 5, 1982, now abandoned.

BACKGROUND OF THE INVENTION

The subject of the invention is a method of preparing a mixture from liquid fuel in an internal combustion piston engine.

SUMMARY OF THE INVENTION

The method of preparing a combustible mixture, known from the patent specification DT No. 1576009, consists in injecting to one cylinder a stream of fuel totally or partially sprayed by hot high-pressure gases collected from the working space of another cylinder. Gas compressed or expanded in another cylinder is supplied to a spray nozzle situated in the suction pipe or in the combustion chamber.

There are also solutions known, in which the combustible mixture is produced in result of supplying to the combustion chamber liquid fuel atomized in a stream of compressed air. The example of such type of solutions is compression-ignition engines produced in the periodical DT "Motortechnische Zeitschrift" No. 9 of 1971, on pages from 306 to 311.

The stream of compressed air is obtained in said engines in result of a specific configuration of the piston head and the head. The projection in the piston head is introduced in the range of the top dead center into the recess of the head corresponding to it geometrically. Apart from the combustion chamber enclosed between the recess and the projection, a transfer chamber is separated, limited by surfaces of the cylinder and of the piston head and the head in the range between the working diameter and the projection. The combustion chamber and the transfer chamber are connected by means of a passage led in the head, in which a fuel atomizer is built in. At the end of the compression stroke, in the range of the top dead center, the pressure difference appearing in chambers causes a flow of air through the passage, an outflow and introduction of fuel to the combustion chamber in a stream of air forced through. The main object of the above presented solutions was to eliminate a complicated expensive injection pump and to improve the atomization of fuel.

The above presented solution with forcing through of the load in the range of the top dead center is also employed by a spark-ignition engine according to the patent DT No. 2306230. For the purpose of combustion of weak mixtures and of reducing the toxicity of exhaust gases, into the load forced through the passage fuel is injected to produce a rich combustible mixture whose stream is directed onto the sparking plug. The proper atomization of fuel requires the application of a high pressure obtained from the feed system based on the injection pump.

The solution according to the invention is to provide a highly efficient piston combustion engine, achieved by a solution which is simple, cheap and which fulfils the conditions of complete combustion. For this purpose a new method of preparing a combustible mixture has been worked out. Fuel atomized in a stream of combustion gases, for example sucked in from the exhaust passage of the engine, produces an incombustible fuel-combustion mixture which is fed under low pressure during suction or exchange of the load to a separate storage space. In the storage space the fuel-combustion mixture is then compressed by air inflowing from the working space, in a positive-displacement manner, without mixing. Such compression is achieved as a result of a laminar flow of air to a space shaped so that it does not cause whirls of the gas. Chemical delimitation of the phase of air and of the phase of the fuel-combustion mixture at simultaneous considerable internal cooling of evaporation of a considerable dose of fuel in a small amount of exhaust gases and at intensive cooling of the walls of the storage space gives conditions excluding spontaneous ignition even at high compression ratios. Before the top dead center of the piston, at the moment settled as appropriate for ignition, the load of the storage space is forced through to the combustion chamber in result of the pressure difference, wherein it is mixed with air to form a combustible mixture and is ignited.

The internal combustion engine operating according to the presented method of preparing the combustible mixture utilizes the configuration of the piston and the head which delimit in the range of the top dead center the combustion chamber and the forcing-through chamber. Additionally, it has a separated storage space which is periodically connected, by means of a periodically cutting-off mechanism, with an exhaust gases passage comprising a device which atomizes the fuel. The storage space is shaped so that it connects in a through manner the forcing-through- and the combustion chambers separated in the range of the top dead center of the piston. With the storage space situated in the engine head, periodic feeding with the fuel-combustion mixture is performed by the cut-off mechanism which is a non-return pressure-controlled valve. The storage space can be also situated in the piston head and in such case it through shape is determined by holes led out onto the projection and the flank of the piston, and the function of the cut-off mechanism is performed by the co-operation of the piston with the outlet of the passage of the fuel-combustion mixture, which is led out onto the cylinder wall. The presented solution can be employed both in a four-stroke- and a two-stroke working cycle of the engine. In two-stroke engines feeding of the storage space with the fuel-combustion mixture is performed by means of a system of additional combustion- and air passages, with a utilization of pressure fluctuations in the subpiston chamber, initiating the flow. The invention can be utilized in compression-ignition engines or in spark-ignition engines.

The presented solution enables in a simple way the realization of high compression ratios without uncontrolled self-ignition or detonation. High quality and lamination of the prepared combustible mixture give in result low specific fuel consumption and cleanness of exhaust gases.

BRIEF DESCRIPTION OF THE DRAWINGS

The full understanding of the invention will be made possible by knowing a few exemplary designs of engines, based on the presented essence of the solution. In drawings the engines are shown in a schematic way, and particular figures present.

DESCRIPTION OF THE PREFERRED EMBODIMENTS

Figure 1:
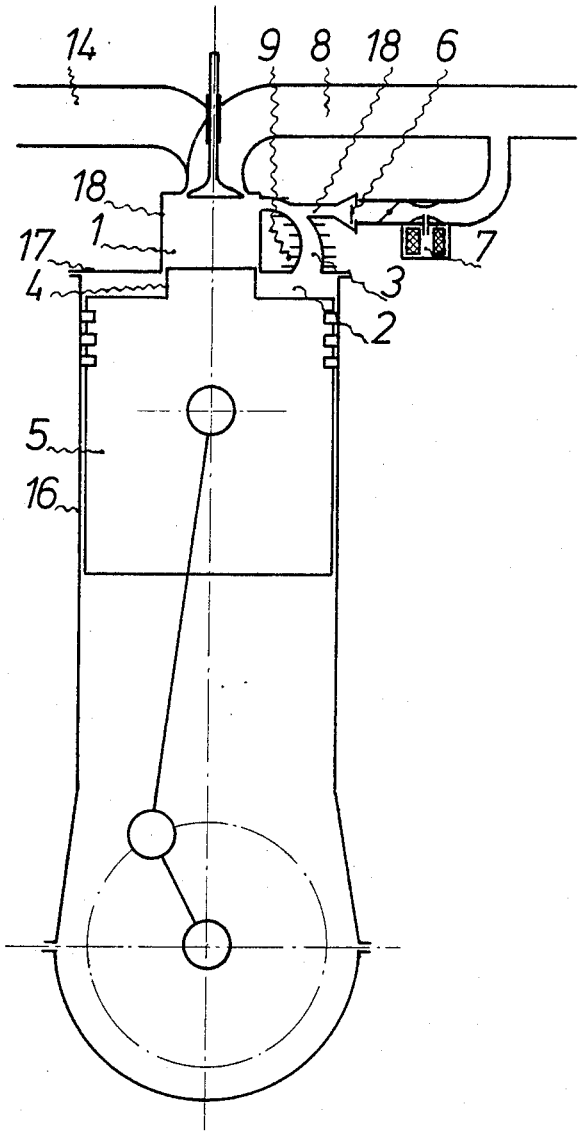
FIG. 1—a four-stroke compression-ignition engine.

The working space of the engine presented in FIG. 1 is determined by a cylinder 16, a piston 5 having on its head a projection 4, and a head 17 with a recess 18. The projection 4 corresponds geometrically in its shape to the recess 18 so that their linking in the range of the top dead centre of the piston separates from the working space a combustion chamber 1 and a forcing-through chamber 2. In the head 17 there is a storage space 3 connecting the combustion chamber 1 and the forcing-through chamber 2. The shape of the storage space 3 as slender space widening from the side of the compressed air inflow is to ensure a laminar inflow of the air stream. To the space 3 a lateral feeding passage 19 is connected, which is coupled through a self-acting non-return plate valve 6 and a carburetor 7 with an outlet passage 8 of exhaust gases of the engine.

During the intake stroke, due to pressure differential, air is fed to the working space through a suction passage 14, whereas fuel flows from carburetor to the storage space 3 through the valve 6 then atomized in exhaust gases. So, the storage space 3 is a periodical container of the fuel-combustion mixture. The walls of the space 3 are intensively cooled, for example, by means of air collecting the heat from the outer surface of the storage space 3, provided with fins 9. The air pressure increasing during the compression stroke acts upon the fuel-combustion mixture in the space 3, the laminar inflow of air does not cause a displacement of gases but only laminar compression of the mixture in the space 3. The mixture obtained from evaporation of fuel in a small amount of, in principle, oxygen-free exhaust gases and in the intensely cooled space does not cause the hazard of self-ignition. At the end of the compression stroke, when the projection 4 is introduced into the recess 18, there is an increase of pressure in the forcing-through chamber 2, and in effect, the scavenge of air through the space 3 into the combustion chamber 1 occurs. The fuel-combustion mixture introduced into the combustion chamber 1 is mixed with hot air to form a combustible mixture which is self-ignited.

Figure 2:
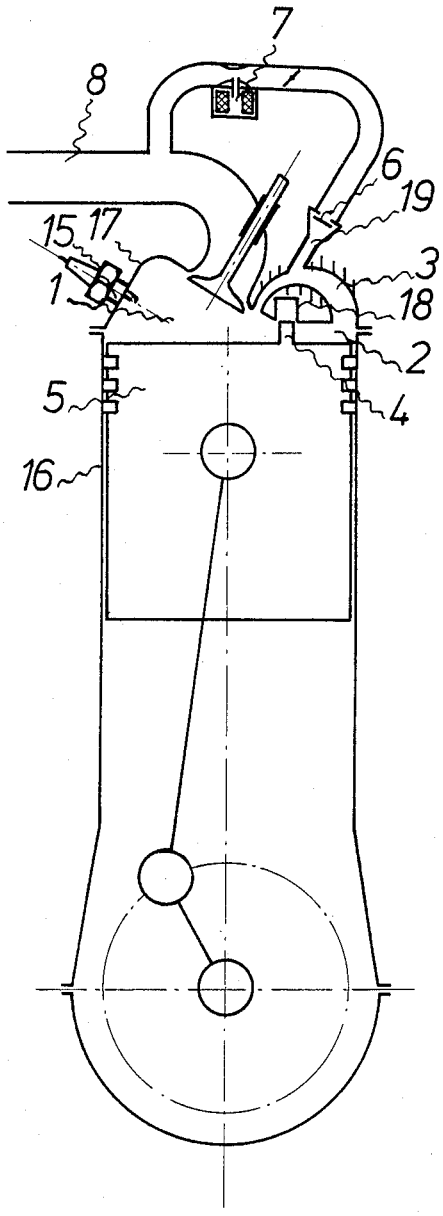
FIG. 2—a four-stroke spark-ignition engine with the piston and the head differently shaped, FIG. 3—a two-stroke engine loaded from the crankcase, FIG. 4—another solution of two-stroke spark-ignition engine, and FIG. 5—a two-stroke engine with the storage space situated in the piston head.

FIG. 2 presents a diagram of a four-stroke spark-ignition engine having the shape of chambers different from the previous one. The projection 4 shaped linearly according to the chord on the head of the piston 5 is introduced into the grooved recess 18 and constitutes a sort of labyrinth seal between the separated forcing-through chamber 2 and combustion chamber 1. Such a configuration causes a local pressure increase and increases the dynamic character of the scavenge between the chambers. The combustion chamber 1 is wedge-shaped and has a sparking plug 15 fixed in the direction of the stream flowing out from the storage space 3. Except for controlled ignition, the process of production of the combustible mixture and of the operation of the engine is identical as in the previous example.

Figure 3:
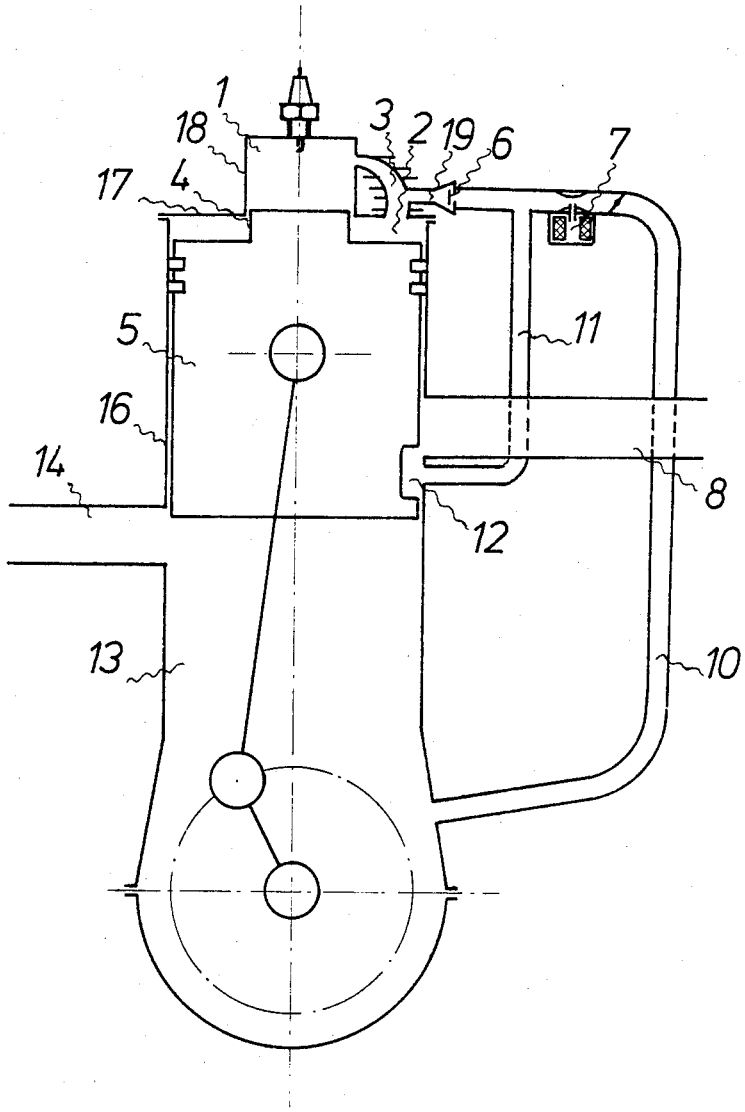

An example of realization of the invention in the application to a two-stroke engine loaded from a crankcase is shown in FIG. 3. The principal elements and the separated chambers of the engine are the same as in the previously discussed four-stroke engines. Differences appear in feeding of the storage space 3. The lateral feeding passage 19, behind the valve 6, branches out into: a suction-free passage 10 connected with a sub-piston space 13 and a combustion passage 11 whose other end is led out onto the inner wall of the cylinder 16 in the vicinity of the port of the outlet passage 8. The skirt of the piston 5 is provided with a recess 12 connecting in the range of the top dead centre of the piston the outlet passage 8 with the combustion passage 11. The carburetor 7 is installed in the suction-force passage 10. Filling up of the storage space 3 with the fuel-combustion mixture occurs during the period of the exchange of the load in the cylinder. During the period when in the sub-piston space 13 there is negative pressure and air is sucked in by the suction passage 14, the recess 12 in the piston 5 connects the combustion passage 11 with the outlet passage 8. A small dose of exhaust gases is sucked in to the passage 11 and the valve 6 closed at this phase exhaust gases flow to the passage 10. Fuel atomized during the flow through the carburetor 7 forms the fuel-combustion mixture occupying the space of the suction-force passage 10. During the compression of air in the subpiston space 13 the mixture is forced through the valve 6 to the storage space 3, the skirt of the piston 5 closing the combustion passage 11. The next stroke of the piston 5 in the direction of the top dead centre causes the previously known phenomenon of compression, forcing the fuel-combustion mixture to the combustion chamber 1, mixing with air and ignition of the obtained combustible mixture.

Figure 4:
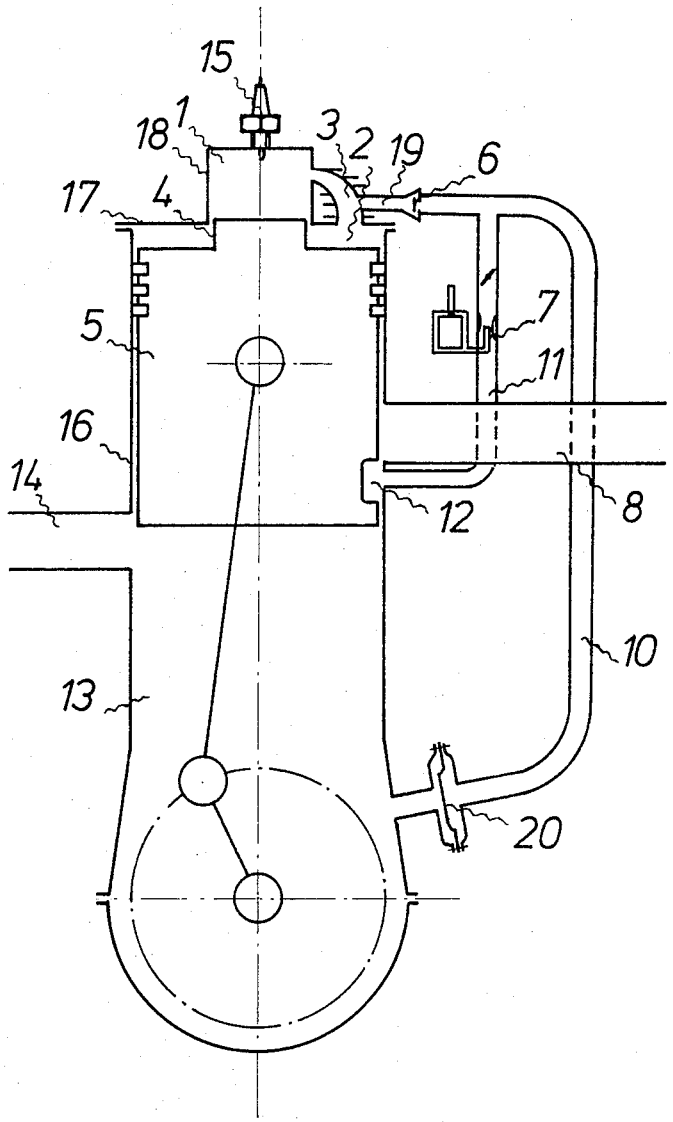

FIG. 4 presents a functional diagram of a two-stroke spark-ignition engine having in comparison to the above described engine a difference in the feed system. The difference consists in a changed position of the carburetor 7 which is built in on the combustion passage 11, and in the application in the suction-free passage 10, a membrane 20 insulating the subpiston space 13 and at the same time transferring the pulses of pressure changes. Such a solution, maintaining the required functions of the system, ensures the homogeneity of gases pulsating in the feed system and thus has an effect upon the stability of operation of the two-stroke engine.

Figure 5:
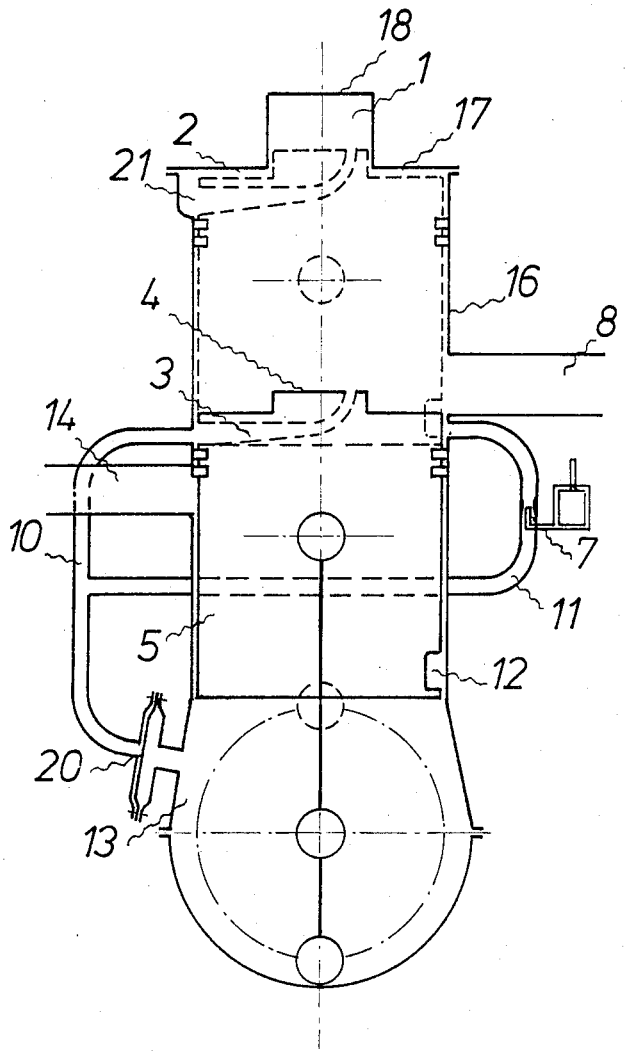

The above described engines have a storage space 3 situated in the head 17. FIG. 5 shows a diagram of a two-stroke engine loaded from the crankcase, having the storage space 3 made in the head of the piston 5. The through space 3 has holes at it ends, whereof one is situated on the flank of the piston 5 and the other one is led out onto the upper surface of the head of the piston 5, in the range of the areas limiting the combustion chamber 1—that is, in this solution, onto the projection 4. The hole in the flank of the piston 5, in the position of the bottom dead center of the piston, is in line with the outlet of the suction-force passage 10, let out onto the inner wall of the cylinder 16. The suction-force passage 10 is connected with the subpiston space 13 through the intermediary of a pressure relay provided with the membrane 20. To the suction-force passage 10 the combustion passage 11 is connected, in which the fuel carburetor 7 is installed. The combustion passage 11 is connected with the outlet passage 8 of exhaust gases by means of the solution known from the examples in FIGS. 3 and 4, by the recess 12 in the piston 5. The upper part of the cylinder 16 is provided with a cut-out 21 connecting through the hole in the flank of the piston 5 the forcing-through chamber 2 with the storage space 3. In the presented engine the function of the mechanism cutting off the inflow of the fuel-combustion mixture to the storage space 3 is performed within the framework of the slotted timing gear by the motion of the piston 5 in relation to the ports of the cylinder 16—due to which the valve 6 has been eliminated. The course of production of the mixture is nearly identical with the previous ones, the advantageous difference consists in geometric, tight closing of one side of the storage space 3 during compression of the load. In conditions of a one-sided inflow of air from the hole on the projection of the piston 5, compression of the fuel-compression mixture in the storage space 3 proceeds fully in a positive-displacement manner, without whirls—which enables, in result, the application of higher compression ratios without the appearance of the phenomenon of premature self-ignition.

What is claimed is:

1. In a method of preparing an enhanced combustible mixture for an internal combustion piston engine, having a cylinder with a cylinder head, a piston movable in said cylinder between a bottom dead center position and a top dead center position, a working space defined by the surfaces of the cylinder, of the piston and of the cylinder head, said engine being controlled by timing means and operable through cyclical strokes which include intake, compression, combustion and exhaust, the improvements which comprise the steps of: connecting said working space to a source of air before said compression stroke; producing a mixture of exhaust gases and atomized fuel droplets and supplying said exhaust gas and fuel mixture to a storage space closely adjacent to but separate from said working space of the engine; then during said compression stroke in the working space, providing for a laminar inflow of air by virtue of positive displacement of the fuel and exhaust gas mixture in the storage space and compressing the same so that the mixture maintains a non-combustible chemical composition in said storage space during said compression stroke; and as said piston approaches said top dead center position which terminates said compression stroke, applying said mixture with said air flow to produce a sudden pressure increase in said storage space causing immediate pumping into said working space of said mixture of fuel and air for subsequent combustion therein.

* * * * *